United States Patent [19]

Suzuki et al.

[11] 4,265,188

[45] May 5, 1981

[54] ELECTRIC SEWING MACHINE

[75] Inventors: Kazuo Suzuki, Oohasuhigashi; Hirokazu Koda, Gose; Kenichi Nakamura, Nara; Syuich Yoshikawa, Nara; Naoki Ohara, Aichi, all of Japan

[73] Assignees: Aishin Seiki Kabushiki Kaisha, Aichi; Sharp Kabushiki Kaisha, Osaka, both of Japan

[21] Appl. No.: 45,762

[22] Filed: Jun. 5, 1979

[30] Foreign Application Priority Data

Jun. 6, 1978 [JP] Japan ..... 53-68465

[51] Int. Cl.[3] ..... D05B 3/02; D05B 3/06

[52] U.S. Cl. ..... 112/158 B; 112/158 E; 112/275

[58] Field of Search ..... 112/158 B, 158 E, 275, 112/277, 121.11

[56] References Cited

U.S. PATENT DOCUMENTS

| | | | |
|---|---|---|---|
| 4,077,341 | 3/1978 | Kasuga | 112/158 B |
| 4,080,914 | 3/1978 | Ishida | 112/277 |
| 4,106,418 | 8/1978 | Hayashi | 112/158 B |
| 4,161,150 | 7/1979 | Brown | 112/158 B |

*Primary Examiner*—Peter P. Nerbun

*Attorney, Agent, or Firm*—Birch, Stewart, Kolasch & Birch

[57] ABSTRACT

The present invention is directed to an electric sewing machine provided with a button hole sewing device which comprises a plurality of cams each individually bearing information of tacking stitches, left side stitches of a button hole and right side stitches of the button hole, means for instructing button hole stitching operation and an electric control circuit arrangement which operates to select the cam for tacking stitches upon operation of the instructing means and to select the cam for one of the side stitches automatically after a predetermined number of the tacking stitches are perfected.

8 Claims, 16 Drawing Figures

CLOCK
CLEAR
A>B
A=B
A<B (a) FOOT SWITCH 28
(b) NEEDLE BAR 42
(c) SENSOR 86
(d) FLIP FLOP 253
(e) FLIP FLOP 254
(f) GATE 258
(g)
(h) GATE 257
(i) GATE 256
(j) TRIGGER 502
(k) LATCH 223
(l) GATE 512
(m) TRANSISTOR 506
(n) GATE 308
(o) ONE SHOT 301
(p) ONE SHOT 301 RESET
(q) ONE SHOT 302
(r) TRANSISTOR 293
(s) GATE 303
(t) MOTOR 62

(a) RECTIFIED VOLTAGE (b) OUTPUTS OF SAWTOOTH GENERATOR 410

(c) OUTPUTS OF COMPARATOR 307

(d) OUTPUTS OF THYRISTOR 413

(e) MOTOR 26

(f) INPUT TO COMPARATOR 305

(g) OUTPUT OF COMPARATOR 305

(h) INPUT TO COMPARATOR 307

(i) OUTPUT OF COMPARATOR 292

ELECTRIC SEWING MACHINE

FIELD OF THE INVENTION

The present invention relates to an electric sewing machine, particularly to an electric sewing machine provided with a button hole sewing control device.

BACKGROUND OF THE INVENTION

The button hole stitch consists of upper side tacking stitches T1, a lower side tacking stitches T2, left side stitches T3 and right side stitches T4 surrounding a button hole H as shown in FIG. 1.

There have been proposed various types of electrically operated sewing machines which provide a number of patterns a zig zag sewing. However, in the conventional zig zag sewing machines, when sewing a button hole, an operator operates one of the select switches corresponding to said upper side tacking stitches T1 first, after the tacking stitches T1 are completed the operator must operate other select switch corresponding to the left side stitches T3. In a similar manner as described above, the operator must operate different select switches for the lower tacking stitches and the right side stitches.

Such operation is troublesome for the operator.

SUMMARY OF THE INVENTION

It is, therefore, an essential object of the present invention to provide a button hole sewing device for use in an electric zig zag sewing machine being capable of sewing the tacking stitches and the side stitches of a button hole with simple operation of at least one switch of button hole sewing machine.

It is another object of the present invention to provide a button hole sewing device being capable of selecting left side stitching and right side stitching operation with a single select switch.

The other objects and features of the present invention will be apparent from the description made hereinafter in connection with a preferred enbodiment of the present invention with reference to the attched drawings.

DETAILED DESCRIPTION OF THE PREFERRED EMBODIMENT

Figure 1:
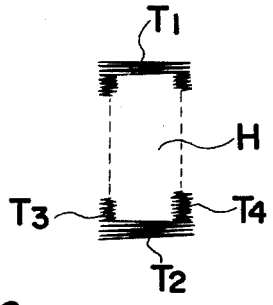
FIG. 1 is a schematic diagram showing an example of button hole stitches.

Before the description of the present invention proceeds, it is to be noted that like parts are designated by like reference numerals throughout the accompanying drawings.

Figure 2:
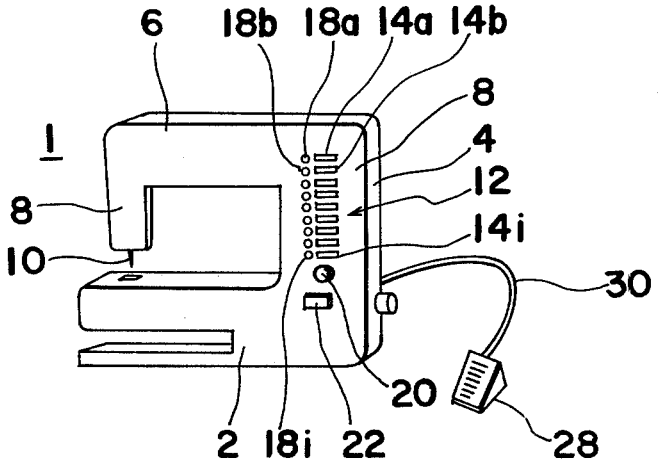
FIG. 2 is a perspective view of a sewing machine according to the present invention.
Figure 3:
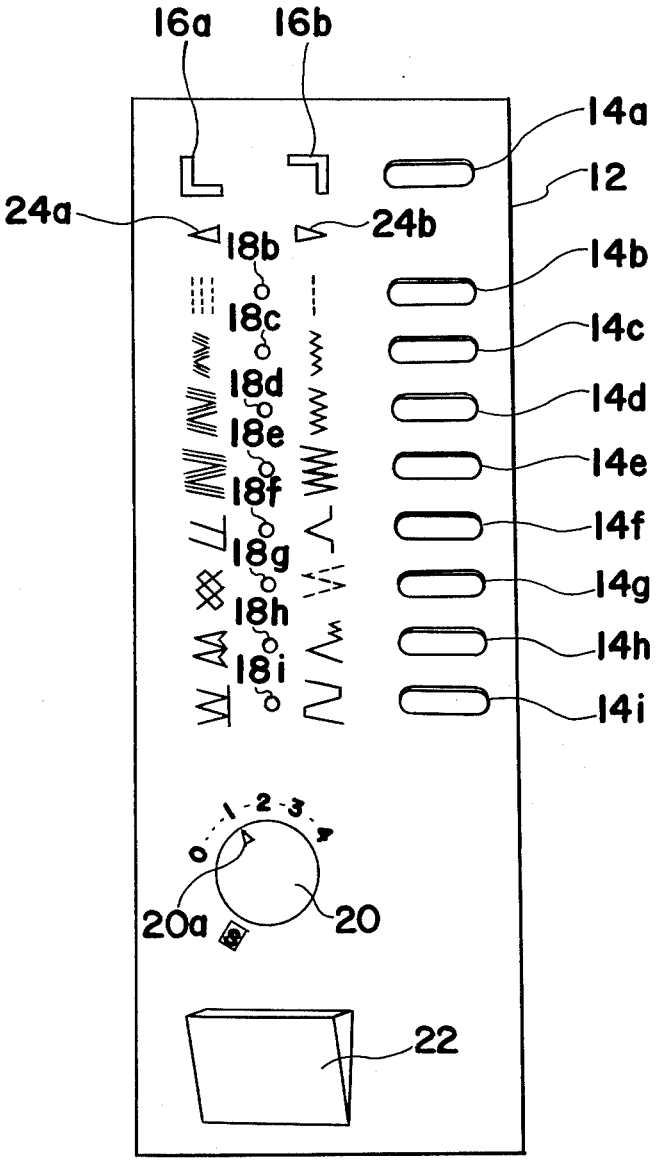
FIG. 3 is a fragmentary view of a control panel provided in a frame of the sewing machine.

Referring to FIG. 2, a sewing machine 1 includes a bed 2 from which rises a standard 4 supporting a bracket arm 6 over hanging the bed 2. The arm 6 supports a head 8 which has a needle 10 projecting outwardly and downwardly towards the bed 2. Disposed on the front surface of the standard 4 is control panel 12, as best shown in FIG. 3, including a plurality of, for example, eight buttons 14*a* to 14*h*, eight indication lamps 18*a* to 18*h* for the selected buttons 14*a* to 14*h*, respectively, a sewing pitch control dial 20 and a button 22 for effecting a retreat movement of the cloth. The sewing pitch control dial 20 has an index arrow 20*a* which is, as the dial 20 is rotated, selectively brought in register with character S and numerical markings scaled adjacent to and around the dial 20. When the arrow 20*a* points "0", the cloth under the needle 10 is held standstill so that the needle 10 can carry out the sewing repeatedly on the same place of the cloth. Upon rotation of the dial 20 to bring the index arrow 20*a* in register with one of the numerical markings, the cloth is advanced in a predetermined sewing pitch determined by the position of the dial 20 so rotated. The sewing pitch is greater as the weight of the numerical markings increases larger. When the dial 20 is rotated to a position S, the sewing pitch is controlled to cause the cloth to advance at a varying pitch. Indication lamps in a shape of an arc are provided around the dial 20 adjacent the numerical markings so that each indication lamp may indicate a predetermined range in the numerical markings. For example, the indication lamp 24*a*, 24*b*, 24*c* and 24*d* cover the numerical range 0 to 0.5, 0.5 to 1, 1 to 2.5 and 2.5 to 4, respectively. Each time the sewing pattern is selected by pushing one of the buttons 14*a* to 14*h*, one or more indication lamp is lit to indicate a range of pitch suited for the selected pattern.

Two groups of sewing patterns are shown one on each side of a column of the indication lamps 18*a* to 18*h*. The sewing patterns of one group shown on the right-hand side of the respective lamps 18*a* to 18*h* are obtained when the arrow 20*a* is in register with one of the numerical markings whereas the sewing patterns of the other group shown on the left-hand side of the respective lamps 18*a* to 18*h* are obtained when the arrow 20*a* is in register with the character S.

Figure 4:
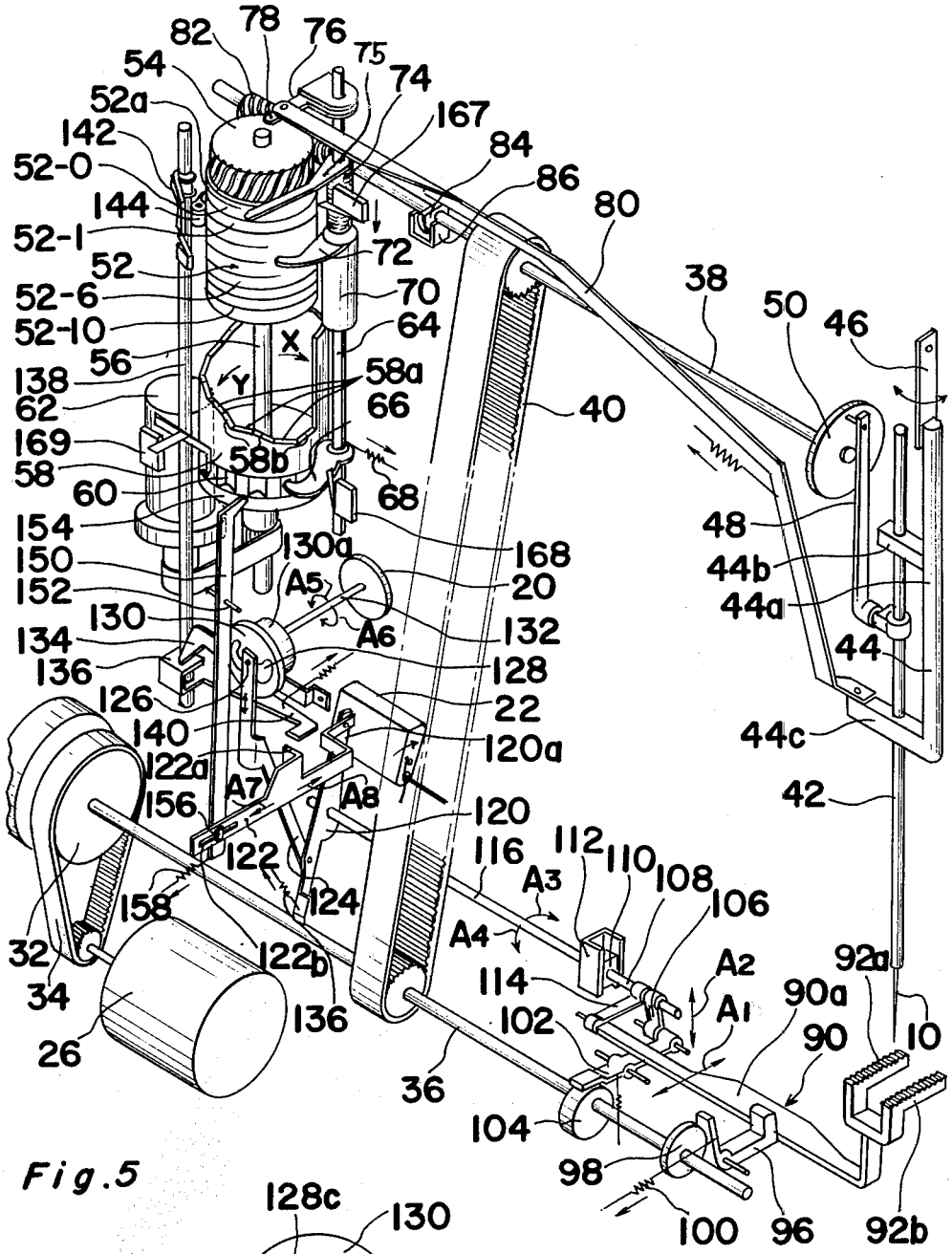
FIG. 4 is a schematic view of a needle actuating mechanism and a cloth moving mechanism which are incorporated in the sewing machine shown in FIG. 2.

Referring to FIG. 4, there is shown a mechanism of the sewing machine 1. The mechanism can be briefly divided into first and second sections, the first section being a needle actuating mechanism while the second section is cloth moving mechanism. Each of such mechanism is actuated by a motor 26 which is controlled by a foot-switch 28 connected to the machine 1 through a cable 30, as shown in FIG. 2. The rotation of the motor 26 is transmitted to a fly-wheel 32 through an endless belt 34. The fly-wheel 32 is rigidly mounted on a shaft 36 which is in common with a main shaft for the cloth moving mechanism. This shaft 36 is connected to another shaft 38 for the needle actuating mechanism through an endless belt 40 so that the shafts 36 and 38 can be rotated simultaneously with each other during rotation of the motor 26. Each mechanism is described in detail hereinbelow.

Needle actuating mechanism

The thread carrying needle 10 is affixed to a needle bar 42 which is slidably supported by an F-shaped framework 44 having an up-right bar 44*a* and two parallel bars 44*b* and 44*c* extending laterally from the bar 44*a*. The needle bar 42 is slidably inserted through holes formed in the bars 44*b* and 44*c*. A rectangular spring plate 46 has one end connected to the upper end of the up-right bar 44*a* and the other end connected to the frame of the sewing machine, whereby the F-shaped framework can undergo a swinging motion. At an intermediate portion between the bars 44*b* and 44*c*, the needle bar 42 is tightly held by a link 48 which is connected to a crank 50 mounted on the shaft 38. Therefore, the rotation of the shaft 38 is converted into the reciprocal movement of the needle bar 42 by the crank 50. The lateral jogging movement of the needle 10 can be obtained by the swing motion of the F-shaped framework 44. This swing motion is controlled by a cam mechanism.

The cam mechanism includes a plurality of cams 52 placed one above the other and rigidly connected to each other. Such cam arrangement 52 is also rigidly connected to a spur gear 54 and is rotatably mounted on a shaft 56 so that the gear 54 rotates together with the cam arrangement freely about the shaft 56. A rod 64 having a rectangular cross section is provided adjacent the cam arrangement 52 with its opposite ends rotatably journalled to the frame of the sewing machine. Mounted on the rod 64 is a cylindrical arm carrier 70 which slidably displaces along the rod 64. A step-formed drum 58 is rigidly mounted on the shaft 56 while a timing cam 60 is also rigidly mounted on the shaft 56. Since an upper annular end of the drum 58 is formed with a generally helical cam face composed of a plurality of steps 58*a* and a corresponding number of slopes 58*b* each positioned between every adjacent two of the steps 58*a*, the arm carrier 70 having its lower end resting on the upper annular end face of the drum descends or elevates along the rod 64 as the drum 58 is rotated in a direction as shown by the arrow X or in a direction as shown by the arrow Y, respectively, about the shaft 56 by a motor 62 connected to the shaft 56. The step-formed drum 58 is provided for supporting the cylindrical arm carrier 70 at a desired level. The position of the drum 58 shown in FIG. 4 supports the carrier 70 at the highest level. Upon rotation of the drum 58 in the direction X by the actuation of the motor 62, the carrier 70 is gradually lowered.

An arm 66 is mounted on the rod 64 at a position adjacent the timing cam 60 by means of a clicking clutch means (not shown), said clicking clutch means being so designed as to enable the arm 66 to rotate clockwise about and independently of the rod 64 and also to rotate counterclockwise together with the rod 64. A free end of the arm 66 remote from the rod 64 is engaged to the timing cam 60.

A spring 68 is connected to the arm 66 to bias the arm 66 and the rod 64 to rotate in a clockwise direction when viewed from top. The cylindrical shaped arm carrier 70 is slidably mounted on the rod 64 and carries an arm or cam follower 72 also mounted on the rod 64. A coil spring 74 mounted on the rod 64 biases the arm 72 and the arm carrier 70 downwardly with a bottom end of the arm carrier 70 held in contact with a stepped upper edge of the drum 58. Since the upper edge of the drum 58 is provided with steps 58*a* and slopes 58*b*, the rotation of the drum 58 moves the carrier 70 along the rod 64 to vary the level of the carrier 70. When the carrier 70 is slid along the slope 58*b* defined between every two neighboring steps 58*a* in the drum 58 for changing the level thereof, the arm 66 slides over a corresponding projecting portion of the timing cam 60. Thus, the arm 66 is pivoted by the rotation of the shaft 64 in a counterclockwise direction. In other words, during the movement of the carrier 70 along the rod 64 with its lower end sliding in contact with any one of the slopes 58*b* in the drum, a free end of the arm 66 slides over a corresponding one of the projections of the timing cam 60. Therefore, during the displacement of the cam follower 72 in the vertical direction, the cam follower 72 is disengaged from the cam arrangement 52.

On the other hand, when the carrier 70 is in contact with a flat edge or step 58*a* of the drum 58, the arm 66 is positioned in a recess defined between the two neighboring projections of the timing cam 60 and, hence, the cam follower 72 is held in contact with one of the cams in the cam arrangement 52. Rigidly mounted at upper portion of the shaft 64 is a disc plate 76 having a projection 78. This projection 78 is pivotally connected to a bar member 80 which extends to the bar 44*c* of the F-shaped framework 44.

The operation of the needle actuating mechanism is described hereinbelow.

Upon one rotation of the shaft 38, the needle 10 undergoes one reciprocation. Also the rotation of the shaft 38 causes the rotation of the cam arrangement 52 through the engagement between the worm gear 82 and the spur gear 54. The rotation of the cam arrangement 52 causes a jogging movement of the cam follower 72 by following projecting lobes or recessed stations and, thus, the projection 78 is jogged accordingly. This jogging movement is transmitted to the F-shaped framework 44 through the bar member 80 to swing the needle 10 laterally. Thus, the zig-zag sewing can be effected according to a pattern determined by the selected cam in the cam arrangement 52 to which the arm 72 is then engaged. When it is necessary to change the cam, that is, to change the level of the arm 72, the motor 62 is turned on by a suitable switch means such as the one electrically coupled to the buttons 14*a* to 14*h* in a manner as will be described in detail later with reference to FIG. 8. When the motor 62 is so turned on the shaft 56 is rotated to rotate the drum 58 and the timing cam 60. The rotation of the timing cam 60 causes the arm 66 to jog accordingly while the rotation of the drum 58 moves the cam follower 72 up or down together with the carrier 70 along the shaft 64. Since the verical displacement of the cam follower 72 is carried out during the movement of the arm 66 over the projecting portion of the timing cam 60, the cam follower 72 is held clear of the cam arrangement 52.

Cloth moving mechanism

A rack member 90 having a pair of saw tooth edges 92*a* and 92*b* and an elongated bar portion 90*a* is movably accommodated in the bed 2 of the sewing machine 1. An L-shape block 96 journalled to the frame of the sewing machine has one end portion held in contact with one side edge of the bar portion 90*a* while the other end portion thereof is held in contact with a disc 98 which is eccentrically rigidly mounted on the shaft 36. The L-shaped block 96 is normally biased in one direction by a spring 100 with said other end portion thereof held in contact with the disc 98. Upon rotation of the shaft 36, the L-shaped block 96 is rocked to provide a lateral movement force to the rack member 90 in a direction as indicated by the arrow A1 in FIG. 4.

An elongated seesaw plate 102 pivotally supported at its substantially intermediate portion by a pin is provided adjacent the L-shaped block 96. This plate 102 has one end overlaying and engaged to a peripheral face of a disc 104 which is eccentrically rigidly mounted on the shaft 36. The other end portion of the plate 102 is hingedly connected to one end of an arm 106. The other end of the arm 106 is also hinged to a bar 108 which extends from a cubic block 110 slidably accommodated in a casing 112 of a substantially U-shaped cross section. The end of the bar portion 90*a* of the rack member 90 remote from the saw tooth edges 92*a* and 92*b* is hinged to one end of an arm 114 while the other end of the arm 114 is also hinged to the bar 108. In this construction, during the rotation of the shaft 36, the plate 102 undergoes a seesaw motion to move the bar 108 vertically in a direction as indicated by the arrow A2 in FIG. 4.

When the groove in the casing 112 is vertically oriented such as shown in FIG. 3, the bar 108 vertically moves as the cubic block 110 reciprocates in the groove of the casing 112. In this case, the rack member 90 is moved only in a vertical direction A2. Therefore, the cloth positioned above the saw tooth edges is held standstill. When the groove in the casing 112 is slant-d in one direction as a result of rotation of a shaft 116 connected to the casing 112 in a direction as indicated by an arrow A3, the cubic block 110 reciprocates accordingly along the groove in the casing 112. In this case, the arck member 90 undergoes such a motion that an end portion of the bar 90*a* of the rack member 90 adjacent the toothed edges 92*a* and 92*b* describes an oval orbit in a counterclockwise direction, when viewed from the right-hand end, whereby the cloth is advanced. The pitch of advance is controlled by the setting of the sewing pitch control dial 20 which determines the angle through which the casing 112 reciprocately rotates together with the shaft 116.

On the other hand, when the groove in the casing 112 is slanted in the other direction as a result of rotation of the shaft 116 in a direction as indicated by the arrow A4, the cubic block 110 reciprocates accordingly along the groove for causing the rack member 90 to move following a similar oval orbit in a clockwise direction when view from the right-hand end. In this case, the cloth is retreated. The manner in which the rotation of the shaft 116 is controlled is described hereinbelow.

Figure 5:
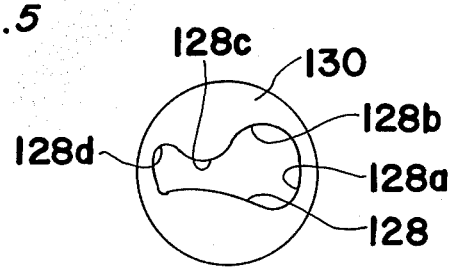
FIG. 5 is a plan view of a disc shown in FIG. 4.

An elongated plate 120 is rigidly connected to the end of the shaft 116 remote from the casing 112. One end portion 120*a* of the plate 120 is pivotally connected to a plate 122, so that the plate 122 moves laterally as a result of rotation of the plate 120. The other end portion of the plate 120 is pivotally connected to a plate 124 which has a pin projection 126 at the end thereof remote from the plate 120. This pin projection 126 is engaged to an edge of a detent recess 128 formed in a disc plate 130. The recess 128 as best shown in FIG. 5 has a predetermined pattern defined by portions 128*a*, 128*b*, 128*c* and 128*d*. The disc 130 is eccentrically connected to a shaft 132 which in turn is connected to the dial 20 described above. Since the plate 120 is biased by a spring 134 about the shaft 116 in a clockwise direction when viewed from right, the pin projection 126 is held in contact with an upper edge of the detent recess 128. When the disc 130 is held in a position as shown in FIG. 3, the edge portion 128*b* of the recess 128 is held in contact with the pin projection 126. It is to be noted that the engagement of the pin projection 126 at the portion 128*b* brings the casing 112 in a position with the groove thereof oriented in a vertical direction as shown. At this time, the dial 20 is in position with the arrow 20*a* held in register with the "0" marking. Upon rotation of the disc 130 in a direction A5, the pin projection 126 comes into contact with the portion 128*a* of the recess 128. Therefore, the plate 124 is raised upwardly to allow rotation of the shaft 116 in the direction A3. Thus, the casing 112 is slanted to effect the orbitary movement of the rack member 90 in such a manner as to advance the cloth. At this time, the dial 20 is in position with the arrow 20*a* held in register with one of the numeral markings.

The disc 130 is coupled with an auxiliary disc 130*a* having a smaller diameter than that of the disc 130. This auxiliary disc 130*a* is also eccentrically connected to the shaft 132. Provided under the auxiliary disc 130*a* is an arm 134 having one end portion pivotally connected to the frame of the sewing machine while the other end is held in contact with a platform 136 slidably mounted on a shaft 138 extending in parallel to the shaft 56. An arm 140 extends from the platform 136 with the free end thereof normally terminating adjacent and above a face 122*a* formed in the plate 122. Since the arm 140 is rigidly connected to the shaft 138, the rotation of the arm shaft 140 accordingly results in rotation of the arm 140. Another arm 142 is also rigidly mounted on the shaft 138 at upper portion thereof. This arm 142 is held in contact with a hinged V-shaped block 144 which is in turn held in contact with the uppermost cam 52*a* in the cam arrangement 52. The uppermost cam 52*a* is provided for controlling the cloth movement. The rotation of the cam arrangement 52 results in a jogging motion of the V-shaped block 144 and also the arm 142. Therefore, the shaft 138 is rotated. This rotation of the shaft 138 is transmitted to the arm 140. Normally, since the arm 140 is free from any element, the rotation or jogging movement of the arm 140 is not transmitted to further element. When the dial 20 is turned to a direction A6, however, the recess 128 is rotated to push down the plate 124 as the pin projection 126 slides along the portion 128*c*. Therefore, the plate 122 is forcibly pushed to a direction A7. The further rotation of the dial 20 in the direction A6 pushes down the arm 134 by the auxilary disc 130*a*, so that the platform 136 is pushed down to lower the arm 140. Thereafter, the pin projection 126 slides into the position 128*d* to substantially raise the plate 124 for moving the plate 122 towards the direction A8. As a consequence, the face 122*a* of the plate 122 comes into contact with the free end of the arm 140. It is to be noted that this is effected as the dial 20 is brought to a position with the arrow 20*a* registered with the "S" marking. The establishment of such connection between the arm 140 and the face 122*a* transmits the jogging movement of the arm 140 through the plates 122 and 120 to the shaft 116, so that the casing 112 is slanted in the direction A3 or A4 with respect to the jogging of the arm 140. Thus, the movement of the cloth is varied.

Figure 6:
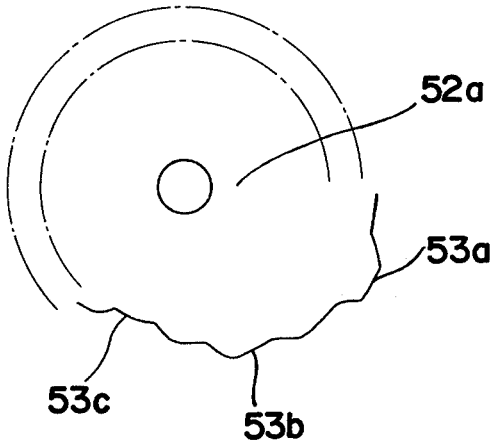
FIG. 6 is a plan view of a cam for controlling the cloth movement.

Referring to FIG. 6, there is shown one example of the cloth moving cam 52*a* having most projecting portion 53*a*, normal level portion 53*b* and recessed portion 53*c*. When the V-shaped block 144 slides over the projecting portion 53*a*, the shaft 116 is turned to the direction A4 to retreat the cloth. When the V-shaped block 144 slides over the normal level portion 53*b*, the shaft 116 is held in such a position as to maintain the casing 112 vertically as shown in FIG. 3, and when the V-shaped block 144 slides over the recessed portion 53*c*, the shaft 116 is turned to the direction A3 for advancing the cloth.

An elongated plate 150 is pivotally supported by a pin 152 with upper end thereof held in contact with a cam 154 positioned under the timing cam 60 and rigidly mounted on the shaft 56. The other end of the plate 150 is provided with a pin projection 156 which is slidably accommodated in an elongated grooves 122*b* formed in the plate 122. A spring 158 is provided for urging the upper end of the plate 150 to the cam 154. Since the biasing force of the spring 158 is larger than that of the spring 136, the movement of the plate 122 particularly in the direction A8 is restricted by the plate 150. In other words, the pin projection 156 limits the lateral movement of the plate 122 within a distance defined by the effective length of the groove 122*b* between the pin projection 156 and the left end of the groove 122*b*. For example, when carrying out a straight stitch, the upper end of the plate 150 will be held in contact with the most projecting portion of the cam 154 so that the effective length of the groove 122*b* between the pin projection 156 and the left end of the groove 122*b* will be considerably large. Thus, upon rotation of the dial 20 to a large numbered position, the shaft 116 can be turned to the direction A3 through a large angle. In other words, stitching is effected at an interval of a relatively large pitch while the cloth is advanced. By all means, it is possible to advance the cloth with a small pitch for this straight stitch by simply turning the dial 20 to a smaller number. On the other hand, when carrying out a button hole stitch, it is necessary to stitch the same place repeatedly. In this case, the upper end of the plate 150 will be held in contact with the most detent portion of the cam 154 so that the effective length of the groove 122*b* between the pin projection 156 and the left end of the groove 122*b* will be zero. Therefore, the plate 122 will not be moved to the direction A8 so as to incline the casing 112 in the direction A3, regardless of turning of the dial 20.

The button 22 is positioned adjacent the upper end of the plate 120 for allowing, when the button 22 is pushed the shaft 116 to rotate in the direction A4. Thus, the retreat movement of the cloth can be effected during the pushing of the button 22.

Figure 16:
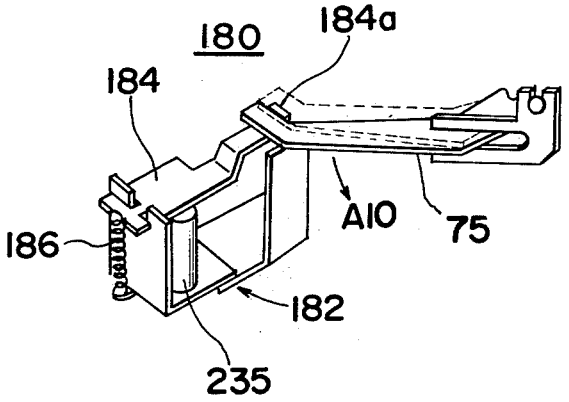
FIG. 16 is a perspective view showing an example of the cam follower releasing arrangement.

In order to ensure to disengage the cam follower 72 from the cam 52 during rotation of the timing cam 60, as shown in FIG. 16, there may be provided a cam follower releasing arrangement 180 having an arm 75 mounted on the rod 64 for rotation simultaneously with the rod 64 and an electromagnet 182 which is provided with a solenoid 235, an armature 184 having an L-shaped free end 184*a* being detouchably engaged with the free end of the arm 75 and a spring 186 biassing the armature 184 so as to raise the L-shaped end 184*a* when the solenoid 235 is not excited. In this case the arm 66 is mounted on the rod 64 through one way clatch (not sown).

By this arrangement, when the solenoid 235 is not excited, the L-shaped end 184*a* of the armature is raised by the force of the spring 186, so that when the arm 75 is rotated in the direction A10 corresponding to the rotation of the rod 64 caused by the oscillation of the arm 66, the free end of the arm 75 is engaged with the L-shaped end 184*a*. Therefore, the arm 75 and the cam follower 72 are prevented from rotation, and only the arm 66 can be oscillated corresponding to rotation of the timing cam 60.

On the other hand, when the solenoid 235 is excited, the armature 184 is attracted onto the core of the electromagnet 182, so that the arm 75 is disengaged from the L-shaped end 184*a* to allow the arm 75 and the cam follower 72 to contact onto the cam 52.

Electric Control Circuit Arrangement

Figure 7:
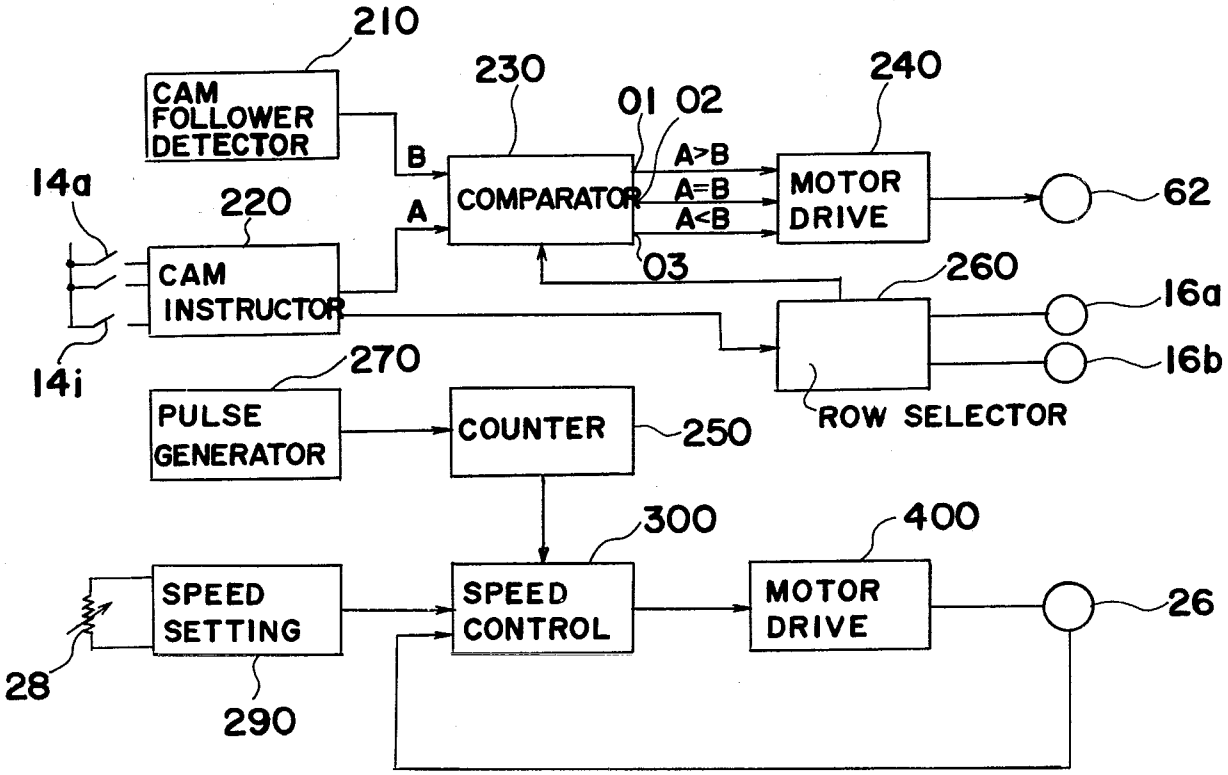
FIG. 7 is a block diagram of an electric control circuit arrangement incorporated in the sewing machine.

Referring to FIG. 7, there is shown a block diagram of the electric control circuit arrangement employed in the embodiment of the present invention, wherein a cam follower detector 210 operates to produce coded signals B of four bits in binary form representing the position of the cam follower.

The cam follower detector 210 is adapted to count the number of the pulses generated every time when the cam follower 72 moves from one cam to the other cam located adjacent to said one cam so as to produce signals representing the number of cam to which the cam follower 72 is opposed.

A cam instructor 220 produces coded signals A of four bits in binary form representing one of the select switches 14*a* through 14*i* operated by an operator. For example, when the operator select the switch 14*a*, the cam instructor 220 produces signals "0001". While no select switch is operated the cam selector 220 produces "0000".

The respective coded signals of the cam follower detector 210 and the cam instructor 220 are fed to a comparator 230 in which the data A are compared with the data B. As a result of the comparison, the comparator 230 produces a signal on any one of the out put terminals 01, 02 or 03 depending on whether the data A are greater than the data B, whether A are equal to B or whether A are smaller than B.

The output signal of the comparator 230 is applied to a motor drive circuit 240 to drive the motor 62 for moving the cam follower 72. Specifically, when the motor drive circuit 240 receives the output signal from the comparator 230 generated through the terminal 01, the cam follower 72 is moved in the downward direction, but when it receives the output signal from the comparator 230 generated through the terminal 03, the cam follower 72 is moved in the upward direction.

By this operation, the cam follower 72 is set on a position corresponding to any one of the cams defined by any one of the select switches 14*a* through 14*i* selected by the operator.

After a required cam is selected, upon operation of the foot switch 28, a speed control signal is fed from a speed setting circuit 290 to a speed control circuit 300, the output of which is fed to a motor drive circuit 400 for rotating the motor 26.

The rotation speed of the motor 26 is fed back to the speed control circuit 300 so that the motor 26 is rotated with such rotation speed as set by the foot switch 28.

By rotation of the motor 26, the cam 52 is rotated and the cam follower 72 is oscillated with the amplitude defined by the shape of the cam thus selected, so that the needle 10 is jogged and the cloth is transferred by the motion of the sew tooth 92*a* and 92*b* as hereinbefore described.

Thus, stitches with required pattern are formed on the cloth.

For sewing button hole stitch, it is required to form a predetermined number of so called tacking stitches on the both ends of the button hole.

For this purpose, a counter circuit 250 is provided for counting the number of tacking stitches by counting the number of pulses fed from a pulse generator 270 which produces one pulse per one complete rotation of the shaft 38, that is, upon sewing of one stitch.

The pulse generator 270 is composed of a magnet 84 being so mounted on the shaft 38 that the detecting means 86 can produce the pulse at the moment when the needle 10 reaches the most raised point.

When the contents of the counter 250 reaches six, that is to say six tacking stitches are formed on the cloth, the counter 250 produces a pulse, which is fed to a speed control circuit 300 so as to stop the rotation of the main motor 26.

A row selector circuit 260 is provided for selecting either the left side stitching or the right side stitching during the button hole stitching operation. The row selector circuit 260 is provided with a flip flop actuated by the signal fed from the button switch 14*a* and operable alternately change in two states one at a time. These two states include a reset state and a set state of the flip flop.

When the flip flop is in the reset state, the indicator 16*a* is lit for indicating that the left side stitching is operable. After the left side stitching is completed, upon operation of the button switch 14*a*, the flip flop is set. When the flip flop is in the set state, the indicator 16*b* is lit for indicating that the right side stitching is operable.

Where the flip flop is in the set state, the row selector circuit 260 acts to supply to the comperator 230 the coded signal "0010" representing the third cam 52-2 for the right side stitching.

After the right side stitching is completed, upon operation of the button switch 14*a*, the flip flop is reset again.

Operation

Before the description proceeds, it is assumed that the upper most cam 52-0 is for left side stitch for button hole sewing, the second cam 52-1 for tacking stitch and the third cam 52-2 for right side stitch.

Figures 8, 8A, 8B:
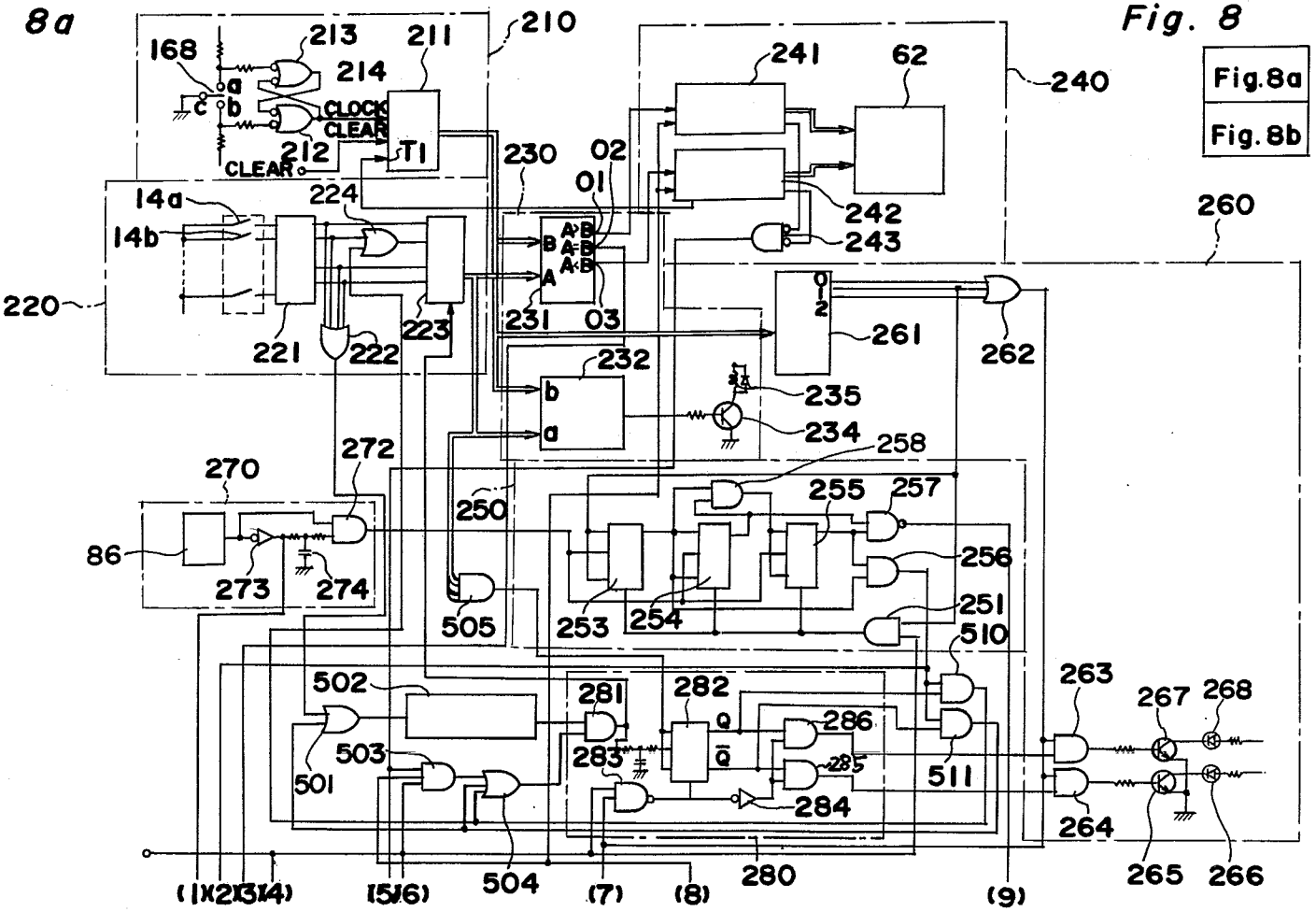
FIG. 8 is a circuit diagram showing the detailed circuit arrangement shown in FIG. 7, said circuit arrangement being divided into two parts which are respectively shown in FIG. 8*a* and FIG. 8*b;*
Figure 8B:
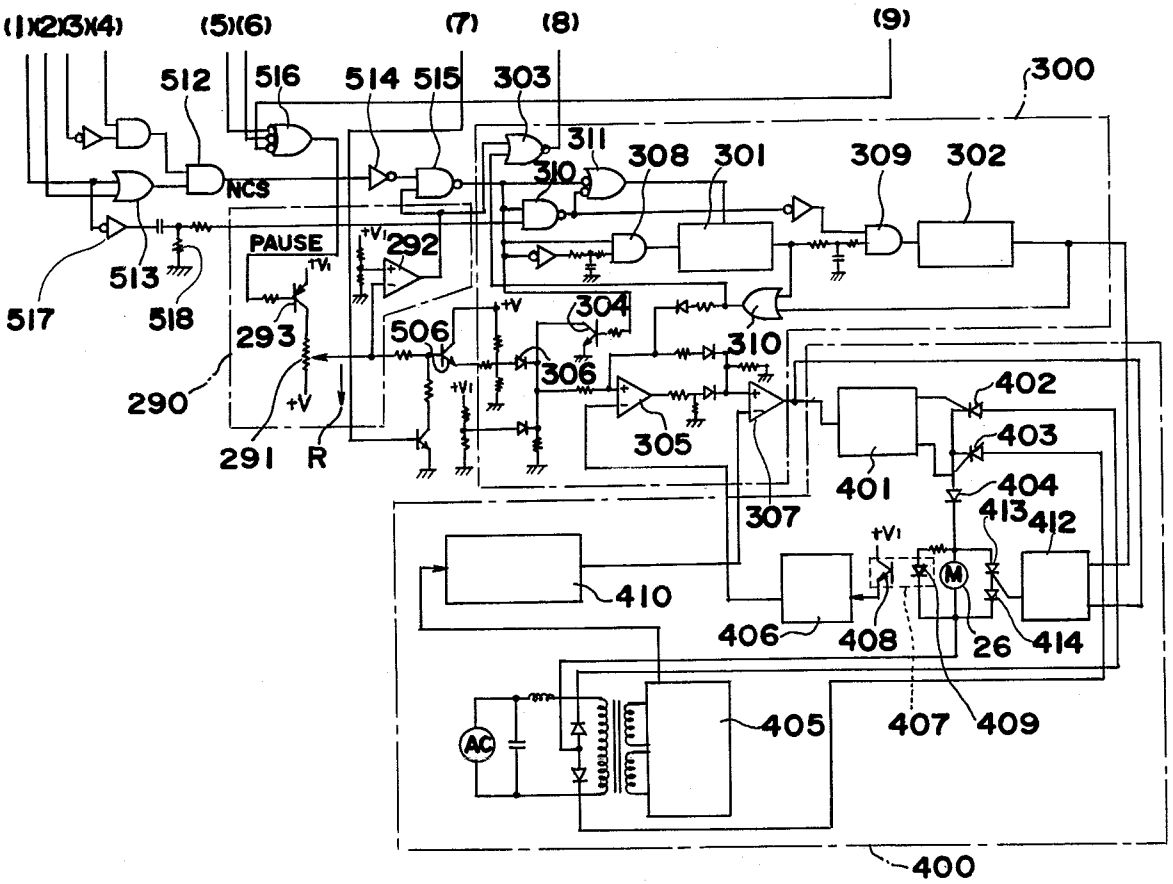
Figure 10:
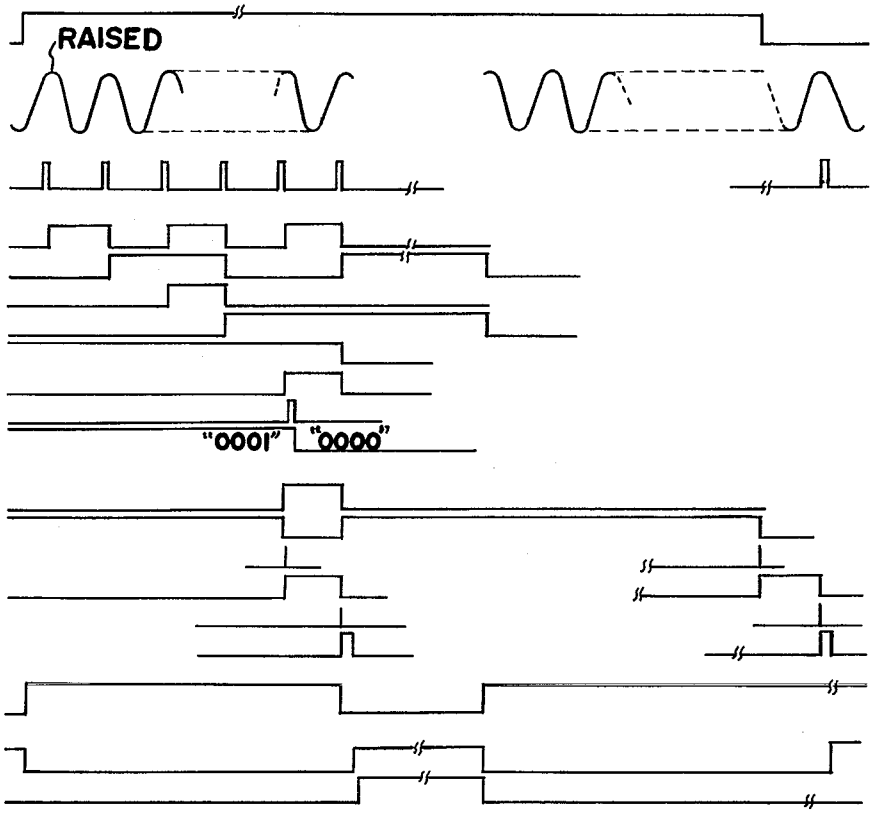
FIG. 10 shows various waves forms appearing on the essential portions of the circuit arrangement shown in FIG. 8.

Referring to FIGS. 8*a* and 8*b*, when the button hole stitching switch 14*a* is pressed, coded signals "0001" indicating the "tack cam" 52-1 is produced from the encoder 221. By this coded signal, the OR gate 222 supplies "1" signal through the OR gate 501 to the trigger circuit 502, which produces a delayed "1" signal to the AND gate 281 (see FIG. 10(*j*)).

Assuming that the motor 62 is not driven, no "1" signal is applied to the NAND gate 243, so that the NAND gate 243 produces "1" signal, which is fed to the AND gate 503. On the other hand, since the foot switch 28 is not operated, the output of the one shot multi vibrator circuit 302 is "0", so that the output "1" of the OR gate 303 is fed to the AND gate 503 which receives SEQ signal of "1", at the remaining input thereof, so that the AND gate 503 sends out a "1" signal to the AND gate 281 through the OR gate 504. Said SEQ signal is adapted to be "0" only while the straight stitching is indicated immediately after the power switch of the sewing machine is ON.

The "1" output of the AND gate 281 is fed to the latch 223 for allowing to memorize the signal "0001" fed from the encoder 221 therein. The "1" output of the AND gate 281 is also fed to the flip flop circuit 282, which remains uncharged since no read-in signal is fed thereto from the AND gate 505.

Assuming that the contents of the counter 211 is "$\alpha$" of four bits, the outputs "$\alpha$" are fed to the B input terminals of the comparator 231 and the "b" input terminals of the comparator 232.

The outputs of the latch 223 are fed to the input terminals A of the comparator 231, so that both values A and B are compared in the comparator 230. If $\alpha<0001$, i.e., the cam follower 72 is located higher than the position of the cam 52-1 for tacking stitch, the output terminal 01 of the comparator 230 becomes "1".

This "1" output signal is fed to the motor control circuit 242 to drive the motor 62 so as to rotate the drum 58 in X direction, for moving the cam follower 72 downward direction.

If $\alpha>0001$, i.e., the cam follower 72 is located lower than the tacking cam 52-1, the output 03 of the comparator 231 becomes "1".

This "1" output signal is fed to the motor control circuit 241 to drive the motor 62 so as to rotate the drum 58 in Y direction for moving the cam follower 72 upward direction.

During the rotation of the drum 58, the arm 66 is swung in correspondence with the passage of the respective projections of the timing cam 60 causing the microswitch 168 ON and OFF. When the free end of the arm 66 is engaged in one of the recesses of the timing cam 60, the microswitch 168 changes to "b" contact from "a" contact, so that the OR gate 212 of the flip flop 214 including the OR gate 213 generates "1" output acting as a CLOCK pulse of up/down counter 211.

In case of the upward movement of the cam follower 72, the counter 211 acts as a down counter since the input terminal T1 is kept "1" by the signal fed from the motor control circuit 242, so that the contents "$\alpha$" of the counter 211 are decreased one by one in response to the "1" signal fed from the OR gate 212 to the CLOCK input terminal corresponding to the displacement of the cam follower 72 from one of the cams to other cam existing just above said one cam.

Through this operation, when the cam follower 72 reaches the position corresponding to the cam 52-2 existing just below the "tacking" cam 52-1, the cam position detector 232 operates to cause the transistor 234 ON to excite the solenoid coil 235 for allowing the cam follower 72 to contact the periphery of the cam 52. When the cam follower 72 reaches the position corresponding to the "tacking" cam 52-1, the contents of the counter 211 become "0001" to produce "1" signal only at the terminal 02 of the comparator 231, therefore the motor 62 is stopped.

The output terminals of the counter 211 are connected to the input terminals of the decoder 261 so that the decoder 261 produces one of the output terminals "0", "1" or "2" corresponding to the contents of the counter 211. Thus, in the above case the decoder 261 produces "1" signal at the "1" terminal connected to the OR gate 262 and the AND gate 251 receiving SEQ signal of "1".

Figure 9:
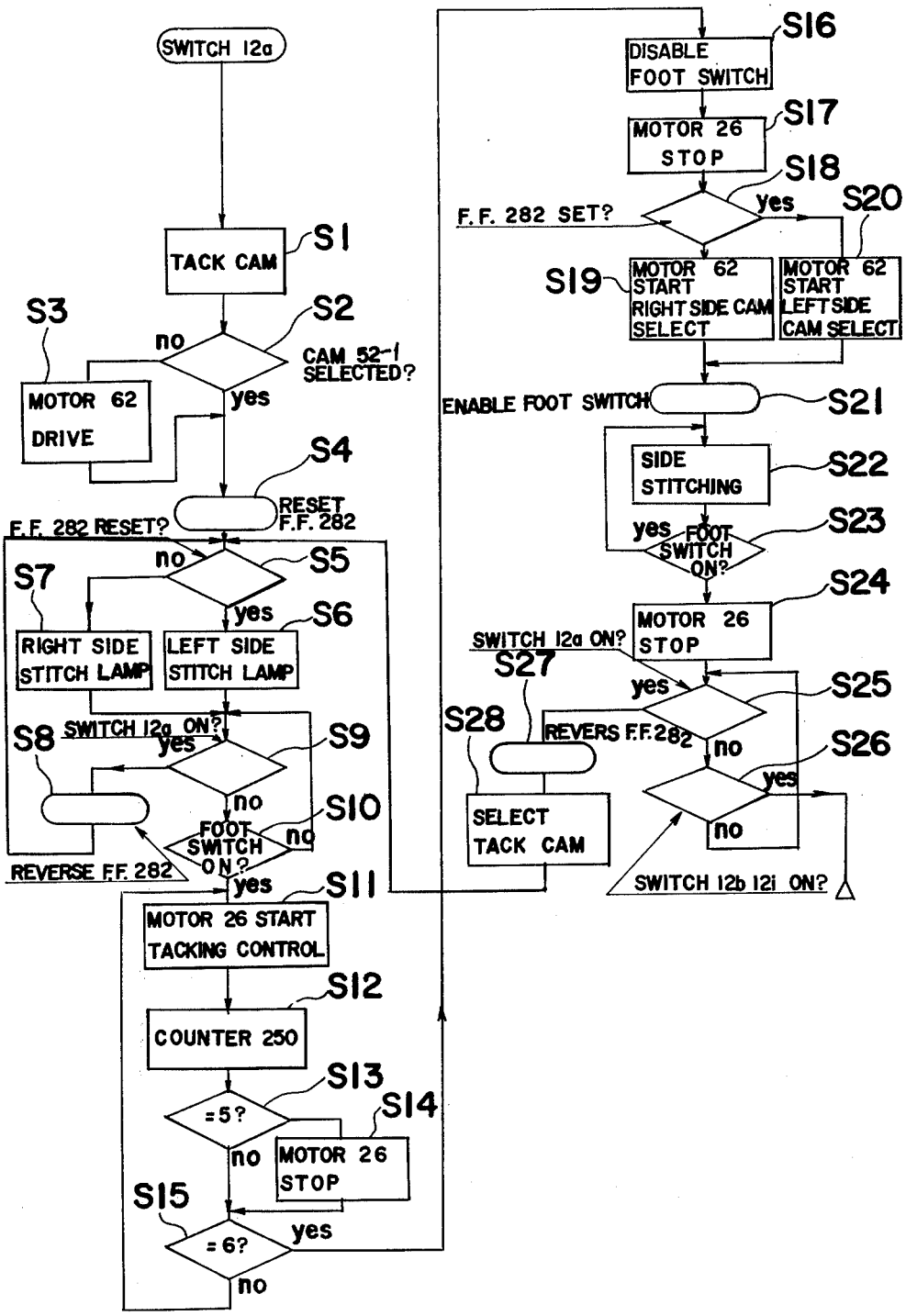
FIG. 9 is a flow chart showing the operation of the circuit arrangement shown in FIG. 8.

Thus, the OR gate 262 supplies "1" signal to the AND gates 263 and 264. Since the flip flop 282 is reset as described above, and the output of the AND gate 283 is "0", and in turn the output of the inverter 284 is "1", the AND gate 285 supplies "1" signal to the AND gate 264 to cause the transistor 265 to be conducted for illuminating the photo emissive diode 266 i.e., the indicator **16*a* for the left side stitching of the button hole shown in FIG. 1. These operations are shown by the respective steps S1 through S7 of the program shown in FIG. 9**.

Under such states, the operator of the sewing machine operates the foot switch 28 to rotate the variable resistor 291 in the direction shown by the arrow mark R to increase the voltage of the base of the transistor 506 and the input voltage of the analogue comparator 292.

Since the transistor 507 is conducted by the "1" signal fed from the OR gate 262, the transistor 506 amplifies the input base signal and supplies a speed control signal with valve proportional to the value of the resistor 291 to the collector of the transistor 304 and the input terminal of the comparator 305 through the diode 306.

The output voltage of the comparator 305 is supplied to the input terminal of the gate control circuit 401 through the comparator 307 so as to control the rotational speed of the main motor 26 by way of controlling the conduction angle of the thyristor 402 and/or 403 connected with the main motor 26 through the diode 404 relative to the phase angle of A.C. power source fed from the power circuit 405.

Figure 11:
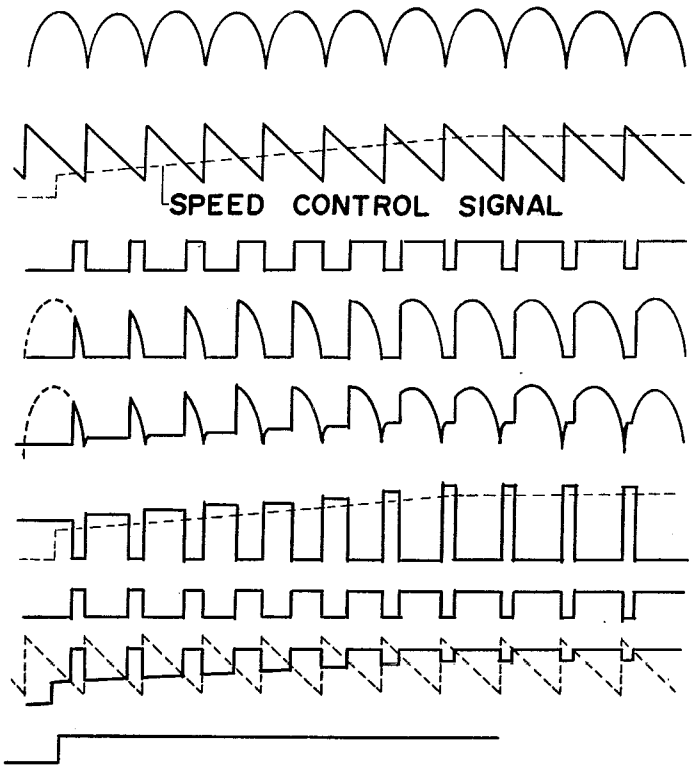
FIG. 11 shows various waveforms appearing on essential portions of the circuit arrangement shown in FIG. 8.

Said comparator 305 compares the speed control signal fed from the transistor 506 and the detected speed signal representing the actual rotational speed of the motor 26 obtained by the speed detecting circuit 406 and produces a pulse train as shown in FIG. 11(G) with various pulse widths changing in proportion with the value of the speed control signal fed from the foot switch 22.

The output pulses of the comparator 305 are superimposed with the speed control signal as shown in FIG. 11(H), being in turn fed to the comparator 307.

Said comparator 307 compares the superimposed signal and saw tooth signals (see FIG. 11(G)) with a frequency twice that of the power supply produced by the saw tooth generator 410, and generates the pulses as shown in FIG. 11(C). Said detecting circuit is adapted to produce the detected speed signal in response to the output voltage of the photo coupler 407 having a photo emissive diode 409 connected with the main motor 26 and a photo sensitive diode 408 receiving the light from the photo emissive diode 409.

When the load of the main motor 26 is large, D.C. voltage component induced in the main motor 26 during the turn-OFF periods of the thyristors 402 and/or 403 becomes low, and then the output voltage of each of the pulses of the speed detecting circuit 406 becomes low. Accordingly, the widths of the output pulses of the comparator 307 during the high level period become large as shown in FIG. 11(G), so that the A.C. power supplied to the main motor 26 becomes high, thereby causing the main motor 26 to drive with higher rotational torque.

In addition, when the foot switch 22 is pushed down deeper, the rotational speed of the main motor 26 becomes faster.

Figure 12:
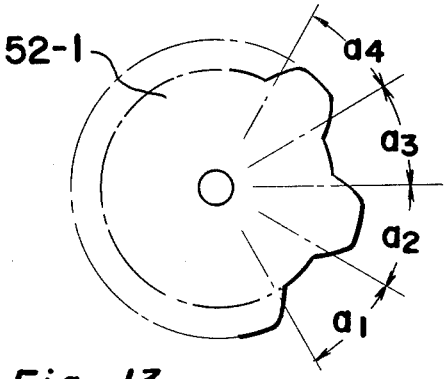
FIG. 12 is a plan view of a cam for controlling tack stitching.
Figure 13:
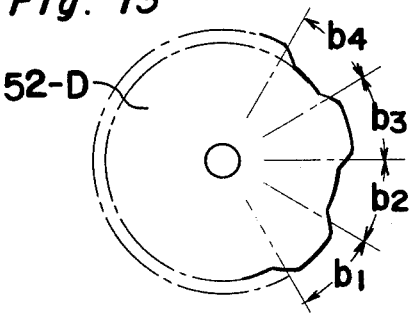
FIG. 13 is a plan view of a cam for controlling left side stitching.
Figure 14:
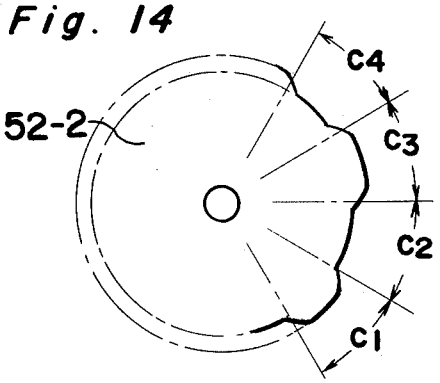
FIG. 14 is a plan view of a cam for controlling right side stitching.
Figure 15:
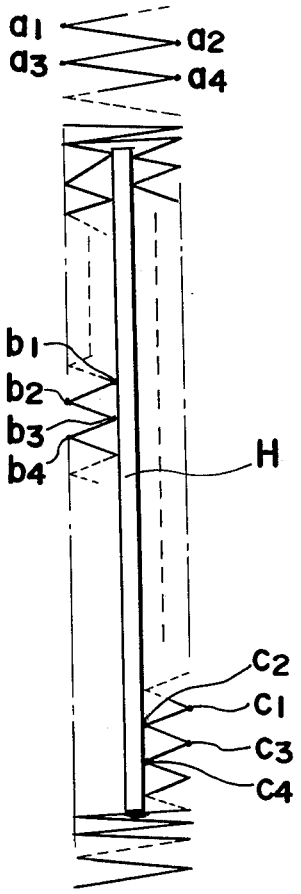
FIG. 15 is a plan view showing an example of button hole stitches.

When the main motor 26 is rotated under the speed control as described above, the needle bar 42 is reciprocally oscillated by the rotation of the main shaft 38 and the cam 52 is rotated by the rotation of the main shaft 38, so that the cam follower 72 contacting the "tacking" cam 52-1 oscillates in correspondence with the shape of the cam as shown in FIG. 12. Since the oscillation of the cam follower 72 reciprocally rotates the rod 64, the projection 78, the needle bar 42 and needle 10 are jogged laterally, whereby the "tacking" stitches T1 are formed in the upper end portion of the button hole H on the cloth as shown in FIG. 15.

During oscillation of the needle bar 42, every time when the needle bar 42 reaches the uppermost position, the senser 86 produces a series of pulses representing uppermost position of the needle bar, each pulse is fed to the AND gate 272 through the inverter 273 and integration circuit 274. Said AND gate 272 produces a series of pulses as shown in FIG. 10(C). The output pulses of the AND gate 272 are fed to the hexa system counter 250 comprising three flip flops 252, 253 and 254 connected in series so as to count the input pulses for detection of the number of stitches formed on the cloth.

When the counter 250 counts 6, the AND gate 256 supplies "1" signal to the AND gates 510 and 511. Since the flip flop 282 is reset so long as the operation for making left side stitching is indicated, the AND gate 511 allows to pass the "1" signal, which are fed to the trigger circuit 502 through the OR gate 501 and to the AND gate 281 through the OR gate 504, thereby the trigger circuit 502 producing "1" signal delayed a predetermined time to the AND gate 281. The output of the AND gate 281 is fed to the latch 223 for enabling to read-in the data fed from the encoder 223 therein. Since none of the select switches **14*a* through 14*i* is operated at this time, the data "0000" fed from the encoder 221 are stored in the latch 223**.

Although the output of the AND gate 281 is fed to the flip flop 282, due to the "0" output of the AND gate 505, the flip flop 282 is kept reset.

The outputs "0000" of the latch 223 are fed to the comparator 231 so as to be compared with the data "0001" fed from the counter 211. As a result of this comparison, the output terminal 03 of the comparator 230 becomes "1" and others 01 and 02 remain "0".

On the other hand, a part of the output of the AND gate 256 is fed to the AND gate 512 through the OR gate 513 to produce "1" signal. The "1" output of the AND gate 512 is fed to the inverter 514 to close the NAND gate 515 to cause the AND gate 308 to supply a set signal to the one shot multi vibrator 301. The output of the one shot multi vibrator 301 is fed to the OR gate 310 and through an integration circuit to the AND gate 309.

The output signal "1" of the gate 515 is also fed to the base of the transistor 304, so that the transistor 304 is turned ON to inhibit the application of the speed control signal fed from the transistor 506 to the comparator 305.

On the other hand, the output of the one shot multi vibrator 301 is fed to the input terminal of the comparator 305 through the OR gate 310, whereby the main motor 26 is rotated at a low speed defined by the voltage fed from the OR gate 310.

As described above, when five tacking stitches are formed on the cloth, the main motor 26 is forced to rotate at low speed defined by the output voltage of the OR gate 310, so that the sixth tacking stitch is formed substantially over-lapping the fifth tacking stitch.

The output of the OR gate 312 is also supplied to the motor control circuits 241 and 242 through the gate 303 for disabling the circuits to inhibit the cam selecting operation.

After the completion of the sixth tacking stitch when the needle bar 42 reaches the uppermost position, the NAND gate 257 is opened by "0" signal fed from the least significant flip flop 255, so that the the output of the OR gate 516 causes the transistor 293 to be cut off to disappear the output voltage of the resistor 291 regardless of the operation of the foot switch 28 to render the output of the comparator 292 to be 0 volt. In addition the output of the senser 86 is supplied to the inverter 517, output of which is differentiated by the differential circuit 518 and then the differential output is fed to the NAND gate 310 which receives the "1" output of the NAND gate 515 to which the "0" output of the comparator 292 is fed. Thus the "1" output of the OR gae 311 is fed to the one shot multi vibrator 301 to reset it and the output of the NAND gate 310 is inverted by the inverter 312 and in turn is fed to the one shot multi vibrator 302 through the AND gate 309 to effect the one shot multi vibrator 302 to produce a pulse with predetermined period as shown in FIG. 10(G).

The output pulse of the one shot multi vibrator 302 is fed to the brake circuit 412 to conduct the thyristor 413 connected with the main motor 26 through the diode 414 so that the main motor 26 is braked by the effect of a dynamic braking to stop the main motor rapidly and stop the needle 10 at the uppermost position.

After the main motor is stopped, the one shot multi vibrator 302 is reset and the OR gate 312 is closed, then the NOR gate 303 supplies "1" output, which is fed to the motor control circuit 241 and 242 for enabling the circuit 241 or 242.

Since the output data of the counter 211 are "0001" and the output data of the latch 223 are "0000" as described above, the comparator 231 produces "1" output at the terminal 03. This "1" output is fed to the motor control circuit 242 so as to drive the motor 62 and the drum 58 in Y direction, so that the cam follower 72 is raised. By the rotation of the drum 58, the arm 66 oscillate and the microswitch 168 is changed over to produce a CLOCK pulse which is to be fed to the counter 211.

When the cam follower 72 reaches the cam 52-0 for the left side button hole stitching, the counter 211 is decreased one by the clock pulse fed from the flip flop, and the counter 211 becomes "0000", so that the comparator 231 produces the "1" output at the terminal 02, and the motor 62 is stopped. The outputs "0000" of the counter 231 cause the decoder 261 to produce "1" signal at the terminal "0", and the output of the AND gate 251 is disappeared then the flip flops 253 to 254 i.e., the counter 250 is reset. Therefore, the transistor 293 is conducted by the "0" signal fed from the OR gate 516 for enabling the resistor 291 to generate the speed control signal. Now the sewing machine is ready to sew the left side button hole stiching. Then, the operator pushes the foot switch 28 down with a suitable depth, the main motor 26 is rotated with the given speed defined by the voltage of the speed control signal. Thus, the cam follower 72 is reciprocally oscillated along the peripheral shape of the cam 52-0 so that the needle bar 42 and the needle 10 are vertically oscillated and jogged with the amplitude defined by the peripheral shape of the cam 52-0.

On the other hand the cloth placed on the sew tooth **92*a* and 92*b* is advanced by a predetermined pitch, then the zig zag stitches T3** are consecutively formed on the cloth along the left side of the button hole.

When the left side stiching as described above is completed and the operator release the foot switch 28, the output voltage of the comparator 292 becomes "0", and then the one shot multi vibrator 301 and 302 are set so as to stop the main motor 26 rapidly in a similar manner as described above.

In order to form zig zag stitches on the cloth along the right side of the button hole, the operator pushes the button switch **12*a* again. By this operation, the encoder 221 produces "0001" signals, which is fed to the comparator 231 through the latch 223**.

By the output of the encoder 221, the OR gate 222 sends "1" signal to the trigger circuit 502 which in turn applies "1" signal to the flip flop 282 to set "1" at the output terminal Q. The set output is fed to the transistor 267 through the AND gates 286 and 263 to light the lamp 268 for displaying the right side stitching.

Since the cam follower 72 is located at the uppermost cam 52-0, and the contents of the counter 211 is "0000", so that the comparator 231 produces "1" output at the terminal 01 to effect the motor control circuit 241 for downward movement of the cam follower 72.

Upon arrival of the cam follower 72 at the second cam 52-1, the comparator 231 produces "1" signal on the output 02 and the output terminal 01 becomes "0".

Accordingly the motor 62 is stopped and the tacking cam 52-1 is selected.

Thus, the "tacking" stitches T2 are formed on the cloth along the lower end of the button hole in a similar manner as described above.

When the counter 250 counts six, i.e., the fifth tacking stitch is completed, the "1" signal is fed to the second input terminal of the latch through the AND gate 510 and the OR gate 224 to write in the latch "0010" representing the third cam 52-2 provided for the right side stitching.

Accordingly the latch 223 applies "0010" to the counter 231, and then the output terminal 03 becomes "1" to enable the motor control circuit 242 for downward movement of the cam follower 72.

After the third cam 52-2 for the right side stitching is selected, zig zag stitches T4 are formed on the cloth along the right side of the button hole in a similar manner as described above.

When the operator pushes the button switch **14*a* again, the flip flop 282 is reset again in response to the application of "1" signal from the AND gate 281** so that the left side stitching now can be operable again.

It is advantageous for an operator that the left side stitching or the right side stitching can be selected simply by operation of the same select button switch so that the operation becomes easy.

In the event that an operator wishes to select other pattern of stitch, for example, the sixth pattern cam 52-5, the operator may operate the push button switch **14*f*. Then the encoder 221 supplies "0101" to the comparator 231 in which the data "0101" and the data fed from the counter 211** are compared so as to produce "1"

signal at one of the terminals 01 or 03. Thus, one of the motor control circuits 241 or 242 becomes effective to drive the motor 62 and to move the cam follower either upward or downward direction. When the cam follower reaches the sixth cam 52-5, the contents of the counter 211 reaches "0101", thereby causing the comparator 231 to produce "1" output signal at the terminal 02. Thus, the motor control circuit 241 or 242 acts to stop the motor 62, and the cam follower 72 is allocated to the sixth cam 52-5.

What is claimed is:

1. An electric sewing machine having a thread carrying needle which is reciprocated in an axial direction thereof and is jogged in a lateral direction, a cloth advancing mechanism for advancing a cloth in a direction perpendicular to the lateral direction at a predetermined pitch after each stitch is formed for forming a predetermined pattern of stitches, said sewing machine comprising:

a plurality of individual pattern information carrying means each provided for controlling the lateral movement of the thread carrying needle, said means including the first information carrying means carrying information indicative of a pattern of tacking stitches of a button hole defined on a cloth, the second information carrying means carrying information indicative of a pattern of left side stitches of the button hole and the third information carrying means carrying information indicative of a pattern of right side stitches of the button hole;

means for reading information carried on any one of said information carrying means;

pattern instructing means including at least one switch for generating an instruction to sew button hole stitches;

pulse generating means for producing a pulse upon the sewing of each stitch in synchronism with the rotation of the shaft for driving the needle;

means for selecting the location of said information reading means to allow said information reading means to read the information carried by said first information carrying means in response to instructions fed from said pattern instructing means;

means for counting the number of tacking stitches formed on the cloth by counting the number of pulses fed from said pulse generating means; and means for selecting the location of said information reading means to allow said information reading means to read information carried by said second information carrying means or by said third information carrying means when said tacking stitches are completed.

2. An electric sewing machine as claimed in claim 1, which further comprises means for storing the one of said second information carrying means or third information carrying means last read by said means for selecting, whereby the one of said second or third information carrying means not selected may be selected upon subsequent operation of said switch.

3. An electric sewing machine as claimed in claim 2, wherein said storing means is a flip flop circuit.

4. The electric sewing machine of claim 1, wherein said switch, when actuated, commands said means for selecting to select said first pattern information means and subsequently to select the one of said second or third pattern information means not selected previously, each generation of said predetermined pattern of stitches causing said means for reading to alternate between said second and third pattern information means.

5. The electric sewing machine as claimed in claim 1, wherein the actuation of said switch generates a binary stable condition which corresponds to stitching either a first or a second side of the button hole.

6. The electric sewing machine as claimed in claim 2, further comprising a display responsive to said switch for indicating the stitching of either the first or second side of the button hole.

7. An electric sewing machine having a thread carrying needle which is reciprocated in an axial direction thereof and is jogged in a lateral direction, a cloth advancing mechanism for advancing a cloth in a direction perpendicular to the lateral direction at a predetermined pitch after each stitch is formed for forming a predetermined pattern of stitches, said sewing machine comprising:

a plurality of individual pattern information carrying means each provided for controlling the lateral movement of the thread carrying needle, said means including the first information carrying means carrying information indicative of a pattern of tacking stitches of a button hole defined on a cloth, the second information carrying means carrying information indicative of a pattern of left side stitches of the button hole and the third information carrying means carrying informaion indicative of a pattern of right side stitches of the button hole;

means for reading information carried on any one of said information carrying means;

pattern instructing means including at least one switch for generating an instruction to sew button hole stitches;

pulse generating means for producing a pulse upon the sewing of each stitch in synchronism with the rotation of the shaft for driving the needle;

means for selecting the location of said information reading means to allow said information reading means to read the information carried by said first information carrying means in response to instructions fed from said pattern instructing means;

means for counting the number of tacking stitches formed on the cloth by counting the number of pulses fed from said pulse generating means;

means for selecting the location of said information reading means to allow said information reading means to read the information carried by said second information carrying means or by said third information carrying means when said tacking stitches are completed;

means for controlling rotational speed of the motor for driving said shaft in response to the speed control signal provided by speed setting means;

means for inhibiting the application of said speed control signal to the control means so as to stop the motor when said counting means reaches a count representative of a predetermined number of tacking stitches; and means for operating the selecting means to allow selection of either said second or said third pattern selection means when a predetermined number of tacking stitches are formed.

8. A sewing machine capable of producing a button hole having a thread carrying needle which is reciprocated in an axial direction thereof and is jogged in a lateral direction, and a cloth advancing mechanism for advancing a cloth in a direction perpendicular to the lateral direction at a predetermined pitch after every one stitch sewing machine comprising:

a plurality of cam members, each providing predetermined information corresponding to an individual stitch pattern, respectively;

a movable cam follower means for detecting the information provided by one of said cam members;

means for moving the cam follower means to select one of said cam members;

motor drive means for actuating said means for moving;

a switch for directing the button hole operation by producing a command signal;

means responsive to said command signal for actuating said motor drive means for moving said cam follower means so that said cam follower means may detect information derived from a first selected cam member related to a tacking operation;

means for sensing the movement of said thread carrying needle and for counting the number of tacking stitches and generating an output when a predetermined number is reached;

means responsive to the output of said sensing and counting means for terminating the tacking operation; and means responsive to said terminating means for actuating said motor driving means to move said cam follower means so that said cam follower means may detect information derived from a subsequent selected cam member related to a side stitch operation.

* * * * *